US009771630B1

(12) United States Patent
Stancescu et al.

(10) Patent No.: US 9,771,630 B1
(45) **Date of Patent: *Sep. 26, 2017**

(54) COLD-FORMED TANK HEAD FOR RAILROAD TANK CAR

(71) Applicant: Samuel, Son & Co., Limited, Mississauga (CA)

(72) Inventors: Daniel P. Stancescu, Toronto (CA); Richard M. Balaz, Milton (CA); Emad Fakhry Habib Assaad, Milton (CA)

(73) Assignee: Samuel, Son & Co., Limited, Mississauga, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/355,620

(22) Filed: Nov. 18, 2016

Related U.S. Application Data

(63) Continuation of application No. 14/177,285, filed on Feb. 11, 2014, now Pat. No. 9,545,932.

(51) Int. Cl.
*C21D 9/00* (2006.01)
*B21D 31/00* (2006.01)
(Continued)

(52) U.S. Cl.
CPC ..... *C21D 9/0068* (2013.01); *B21D 19/00* (2013.01); *B21D 31/005* (2013.01); *B21D 51/18* (2013.01);
(Continued)

(58) Field of Classification Search
CPC ..... B61D 5/08; B21D 31/005; B21D 19/043; B21D 19/02; B21D 19/04; B21D 22/18;
(Continued)

(56) References Cited

U.S. PATENT DOCUMENTS 1,013,046 A 12/1911 Murphy
1,733,385 A 10/1929 Norquist
(Continued)

FOREIGN PATENT DOCUMENTS

| | | |
|---|---|---|
| CA | 328420 | 12/1932 |
| EP | 3858850 | 8/1998 |
| FR | 1404090 | 6/1965 |

OTHER PUBLICATIONS

Faccin USA Inc., "Dished Head Lines" Feb. 11, 2014.
(Continued)

*Primary Examiner* — R. K. Arundale
*Assistant Examiner* — Pradeep C Battula
(74) *Attorney, Agent, or Firm* — Hodgson Russ LLP

(57) ABSTRACT

A method of manufacturing a railroad car tank head includes the steps of providing a circular blank of steel plate material, cold-forming the circular blank to form an intermediate ellipsoidal dish, cold-forming a peripheral flange region of the intermediate ellipsoidal dish to form a flanged ellipsoidal dish, and heat treating the flanged ellipsoidal dish. The heat treatment may be either a thermal stress relieving heat treatment or a normalizing heat treatment. The two cold-forming steps may be carried out at room temperature. The present invention provides a method of making a railroad car tank head that is more efficient than prior methods, avoids the challenges of hot-forming and single-stage cold-forming, is easily adaptable to different tank head diameters using the same forming equipment, and yields a railroad car tank head that meets safety standards.

13 Claims, 5 Drawing Sheets

(51) Int. Cl.

| | |
|---|---|
| ***B21D 19/00*** | (2006.01) |
| ***B21D 51/18*** | (2006.01) |
| ***C21D 8/02*** | (2006.01) |
| ***C21D 1/30*** | (2006.01) |

(52) U.S. Cl.
CPC ..... *C21D 1/30* (2013.01); *C21D 8/0221* (2013.01); *C21D 8/0247* (2013.01)

(58) Field of Classification Search
CPC .... B21D 22/185; B21D 51/18; C21D 9/0068; C21D 1/30; C21D 8/0221; C21D 8/0247
See application file for complete search history.

(56) References Cited

U.S. PATENT DOCUMENTS

| | | | | |
|---|---|---|---|---|
| 1,872,272 | A | 8/1932 | Furrer | |
| 2,197,609 | A | 4/1940 | Cornell | |
| 3,016,942 | A | 1/1962 | Johnson | |
| 3,022,757 | A | 2/1962 | Clough | |
| 3,390,644 | A | 7/1968 | Krauskopf | |
| 3,548,622 | A | 12/1970 | Willard | |
| 4,104,941 | A | 8/1978 | Krueger | |
| 4,835,359 | A | 5/1989 | Sciortino | |
| 4,858,853 | A | 8/1989 | Westerman | |
| 5,426,964 | A | 6/1995 | Sieger | |
| 6,931,720 | B2 | 8/2005 | Thompson | |
| 7,243,517 | B2 | 7/2007 | Sieger | |
| 7,454,936 | B2 | 11/2008 | Michel | |
| 7,563,335 | B2 | 7/2009 | Erike | |
| 9,545,932 | B1 * | 1/2017 | Stancescu | B21D 31/005 |

OTHER PUBLICATIONS

Anderson et al., Quantifying and Enhancing Puncture Resistance in Railroad Tank Cars Carrying Hazardous Materials. Sep. 1, 2006.
AAR Manual of Standards and Recommended Practices Specifications for Tank Cars; Appendix R—Repair, Alteration, and Conversion to Tank Car Tanks. Sep. 30, 2013.
Geffen, An Assessment of the Risk of Transporting Propane by Truck and Train, Mar. 1980, p. B-12. Mar. 1, 1980.

* cited by examiner

COLD-FORMED TANK HEAD FOR RAILROAD TANK CAR

FIELD OF THE INVENTION

The present invention relates generally to railroad tank cars used to carry liquids and gases, including hazardous and flammable liquids and gases. More specifically, the present invention relates to a method of forming "2:1" ellipsoidal heads for cylindrical tanks of railroad tank cars from steel, and to railroad car tank heads made by such method. A "2:1" ellipsoidal head is shaped as an ellipsoid of revolution in which the major axis equals the diameter of the tank shell adjacent the head and the minor axis equals one-half the major axis.

BACKGROUND OF THE INVENTION

Material properties and specifications associated with tank heads used on rail tank cars are directed by the Association of American Railroads ("AAR") under AAR Specification M-1002 entitled "AAR Manual of Standards and Recommended Practices, Section C-Part III, Specification for Tank Cars." AAR Specification M-1002 is governed by DOT 173.31(f), which states:

(f) Special requirements for hazardous substances. (1)

A tank car used for a hazardous substance listed in paragraph (f)(2) of this section must have a tank test pressure of at least 13.8 Bar (200 psig), head protection and a metal jacket, except that—

(i) No metal jacket is required if—

(A) The tank test pressure is 23.4 Bar (340 psig) or higher; or (B) The tank shell and heads are manufactured from AAR steel specification TC-128, normalized; . . . .

AAR Specification M-1002 is also governed by DOT 179.100-8(b), which states: "Each tank head made from steel which is required to be 'fine grain' by the material specification, which is hot formed at a temperature exceeding 1700° F., must be normalized after forming by heating to a temperature between 1550° and 1700° F., by holding at that temperature for at least 1 hour per inch of thickness (30-minute minimum), and then by cooling in air." The purpose of the normalizing heat treat practice is to ensure that the tank head has the impact toughness properties addressed in AAR M-1002, section 2.2.1.2, which requires:

Effective for cars ordered after Aug. 1, 2005, each plate-as-rolled of ASTM A516, A302, A537, and AAR TC128 steel used for pressure tank car heads and shells must be Charpy impact tested transverse to the rolling direction in accordance with ASTM A20. The test coupon must simulate the in-service condition of the material and must meet the minimum requirement of 15 ft-lb average for three specimens, with no single value below 10 ft-lb and no two below 15 ft-lb at −30° F. Plates for low temperature service described in 49 CFR 179.102 that require longitudinal impact testing at −50° F. do not require transverse testing at −30° F.

As is clear from DOT 179.100-8(b), it is industry practice to hot form railroad car tank heads. Hot forming typically involves heating a circular steel plate blank in an oven which may be above the normalization temperature, and pressing the hot steel blank in a hydraulically powered press to form an ellipsoidal tank head. This process is expensive in terms of equipment and is time consuming. The AAR standards do not contemplate or address tank car heads fabricated through a cold forming process and then heat treated after cold forming.

The impact toughness of tank heads for rail cars is of vital importance, as demonstrated by recent tragic accidents in Lac-Megantic, Quebec and Casselton, N. Dak. Lac-Megantic was the site of a train derailment in July of 2013 that killed forty-seven people. In that incident, a freight train with seventy-two tank cars filled with crude oil ran away and derailed, resulting in the fire and explosion of multiple tank cars near the town's center. In addition to the casualties, more than thirty buildings were destroyed. Just outside of Casselton, a train carrying crude oil struck wreckage from a prior derailment on Dec. 30, 2013, igniting the crude oil and causing a chain of large explosions which were heard and felt several miles away. Authorities issued a voluntary evacuation of the city and surrounding area as a precaution. The crash occurred in proximity to a populated area, and it was fortunate that no casualties resulted.

Prior methods of cold-forming tank car heads have involved a one stage cold-forming step wherein a high-force hydraulic press (e.g. a 12,000 ton hydraulic press) is operated to cold-form a steel blank into an ellipsoidal tank head by one pressure stroke or a few pressure strokes. These methods were attempted in the 1960s and earlier.

One drawback of early cold-forming approaches is that the equipment was limited to a single tank car head size specification. In order to adapt the forming equipment to manufacture a variety of tank car head sizes, a corresponding variety of dies had to be provided at high expense. Changing the set-up of the press equipment from one tank head size to another added further time and expense.

More importantly, the use of brute force to cold-form a tank car head in a very short period of time may cause material damage and introduce significant stresses in the material. Where the steel blank is over ⅜ of an inch thick, finite cracks are highly suspect in rapid cold-forming operations. Thus, rapidly cold-formed tank car heads have in the past required very careful and time-consuming inspection.

It is believed that the equipment requirements, inspection demands and quality concerns associated with rapid single stage cold-forming methods of the prior art have more than negated the benefits of faster production, thereby leading to the current acceptance of hot-forming as the industry standard for tank car head production.

Thus, there has long been a need for an improved cold-forming process for making tank car heads that avoids the drawbacks of earlier cold-forming processes. The need for an improved manufacturing process has grown urgent in view of safety concerns raised by recent accidents, including the highly publicized accidents in Lac-Mégantic and near Casselton.

SUMMARY OF THE INVENTION

The invention provides a new method of manufacturing a railroad car tank head. The method departs from prior art methodologies by adopting a two-stage cold-forming process instead of hot-forming or one-stage cold forming. In some embodiments, the method further departs from prior art methodologies by using a stress relieve heat treatment instead of a higher-temperature normalizing heat treatment.

The method of the invention generally comprises the steps of providing a circular blank of steel plate material, cold-forming the circular blank to form an intermediate ellipsoidal dish (the first cold-forming stage), cold-forming a peripheral flange region of the intermediate ellipsoidal dish to form a flanged ellipsoidal dish (the second cold-forming stage), and then heat treating the flanged ellipsoidal dish. In one embodiment, heat treating includes thermally stress relieving the flanged ellipsoidal dish by heat treating the flanged ellipsoidal dish at a temperature below the normalization temperature of the steel plate material. In another embodiment, heat treating the flanged ellipsoidal dish includes a normalizing heat treatment. The two cold-forming steps or stages may be carried out at room temperature.

The circular blank may be cut from ASTM TC128, Grade B, normalized steel plate material. The circular blank may be cold-formed using an automatic dishing press system. In one embodiment, a plurality of circular blanks are cold-formed simultaneously in a dishing press system. The intermediate ellipsoidal dish created by the dishing press system may be cold-formed in a flanging machine to provide a flanged ellipsoidal dish. The temperature of the steel may be monitored during cold-forming to prevent material heating and possible unexpected material deformation associated therewith. Where the heat treatment includes thermally stress relieving the flanged ellipsoidal dish, the dish may be held at a temperature at or just above 1100° F. (e.g. 1150° F.) for a period of time ranging from one hour up to four hours, and then cooled in a controlled manner. The dish may be stress relieved before it is welded onto the cylindrical tank, and/or after it is welded onto the cylindrical tank. Where the heat treatment includes normalizing the flanged ellipsoidal dish, the flanged dish may be held at approximately 1700° F. for more than one-half hour but less than one hour.

The present invention provides a method of making a railroad car tank head that is more efficient than prior methods, avoids the challenges of hot-forming, is easily adaptable to different tank head diameters using the same forming equipment, and aims to yield a railroad car tank head that meets safety standards.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
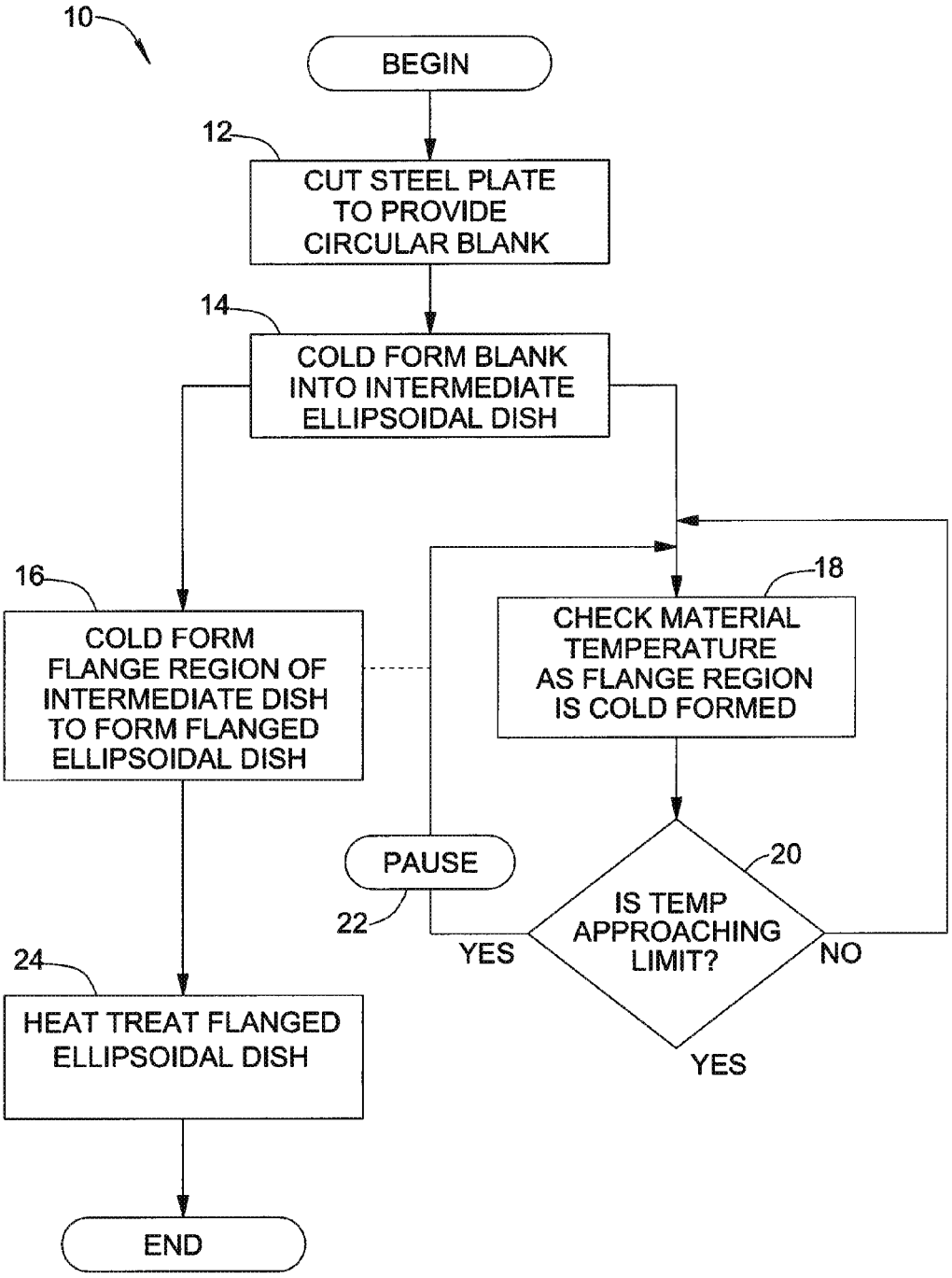
FIG. 1 a flow diagram generally illustrating a process for manufacturing railroad car tank heads in accordance with an embodiment of the present invention.

FIG. 1 generally illustrates a method 10 of manufacturing an ellipsoidal head for a railroad tank car in accordance with an embodiment of the present invention. The method described herein may be used to produce tank car heads for DOT/TC Pressure Cars (Class DOT/TC-105, 112, 114 &120 tank cars). Heads for these tank car classifications are currently produced using a hot forming and normalizing process described above in the Background of the Invention section.

Figure 2:
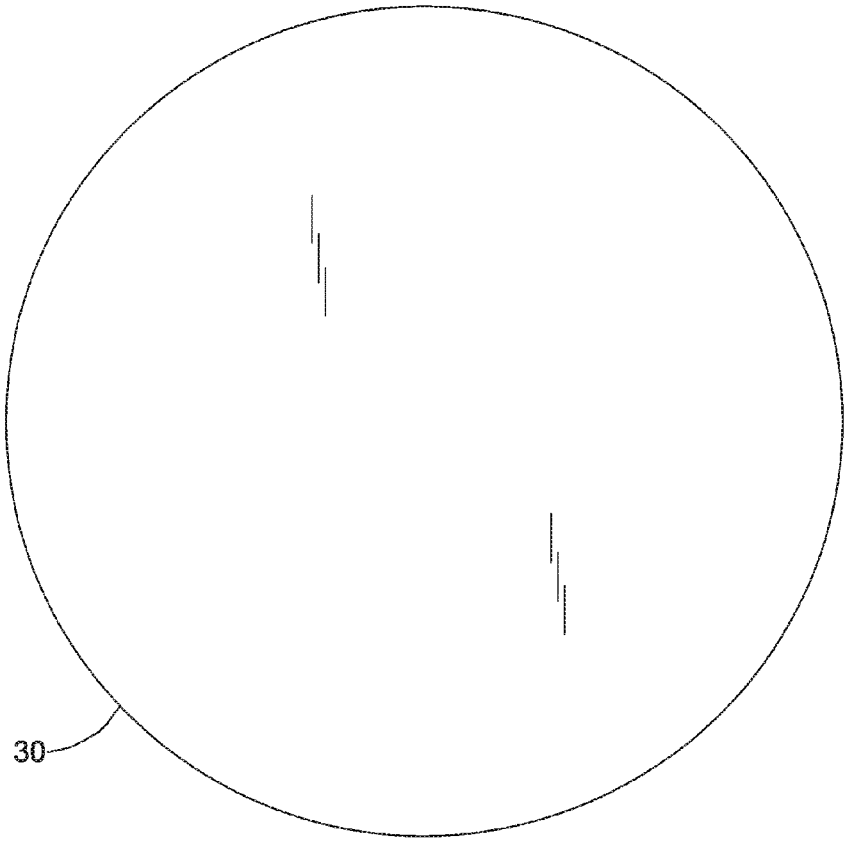
FIG. 2 is a plan view of a circular blank cut from steel plate in accordance with the process of FIG. 1.
Figure 3:
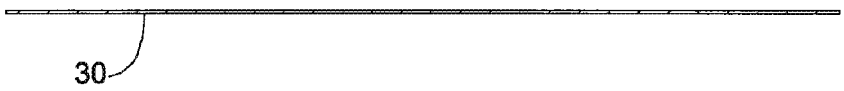
FIG. 3 is a cross-sectional view of the circular blank shown in FIG. 2.

As an initial step indicated at block 12, a circular blank of steel plate material is provided. The circular blank, shown in FIGS. 2 and 3 and identified by reference numeral 30, may be cut from flat plate stock material using a plasma cutter, laser cutter, or other steel cutting technology. Circular blank 30 may be cut from ASTM TC128, Grade B, normalized steel plate, a grade intended for usage in railroad tank car fabrication (this is the only grade approved in North America and Europe for usage in railroad tank car fabrication). Steel plate used by applicant in manufacturing prototype tank car heads for testing the inventive method had a Minimum Tensile Strength, Welded Condition, of 81,000 psi (560 MPa) and a Minimum Elongation in 2" Weld Material of 19%. The thickness of circular blank should be at least ½ inch, but is preferably slightly greater than ½ inch, for example 9/16 inch, to ensure that no portion of the tank car head is less than ½ inch thick after forming due to thickness reduction that occurs during forming. The diameter of the circular blank is chosen depending upon the specified outer diameter of the finished tank car head. By way of non-limiting example, where the outer diameter of the tank car head is specified to be 123.5 inches, the diameter of circular blank 30 may be 148 inches.

Figure 4:
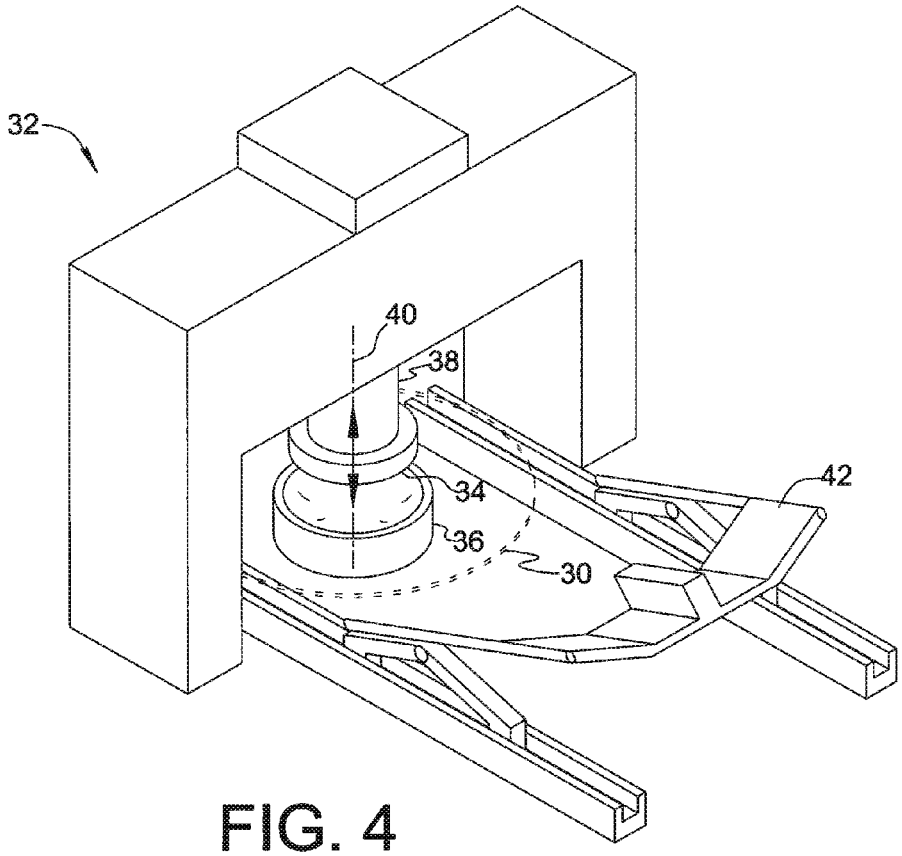
FIG. 4 is a schematic orthogonal view of an automatic dishing press system used in a first cold-forming stage of the process, wherein a circular blank is shown transparently.
Figure 5:
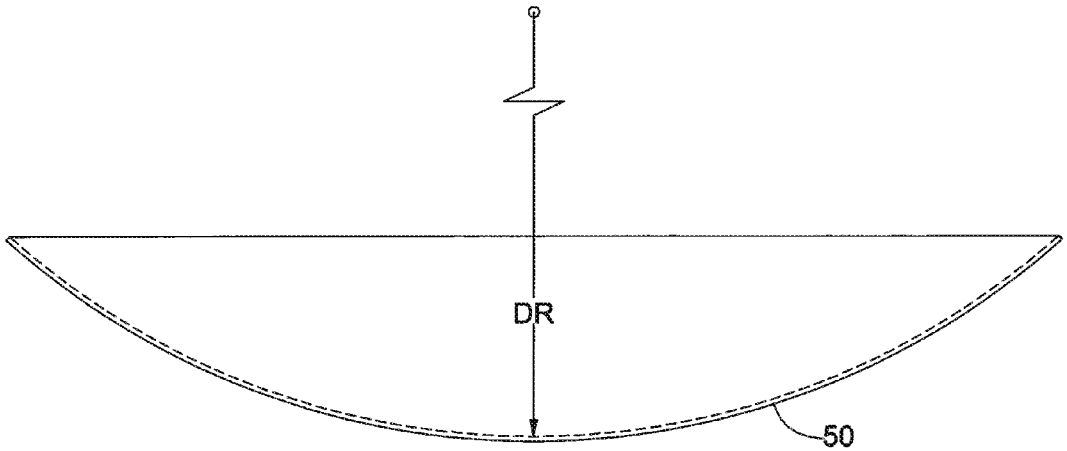
FIG. 5 is a side view of an intermediate ellipsoidal dish formed from the circular blank in accordance with the first cold-forming stage.

Returning to FIG. 1, circular blank 30 is cold-formed in a two-stage cold-forming process represented by blocks 14 and 16. The first stage, represented by block 14, is cold-forming the circular blank to form an intermediate ellipsoidal dish. The term "intermediate" is used to indicate that the ellipsoidal dish is not in final form for use as a tank car head. The term "cold-forming" means that the temperature of the steel material is not greater than 200° F. during the forming process. The first stage of cold-forming may be performed by an automatic dishing press system, illustrated schematically in FIG. 4 and identified generally by reference numeral 32. Automatic dishing press system 32 includes a press die 34 and an opposing fixed die 36. Press die 34 is mounted at the end of a cylinder actuator 38. Actuator 38 may be hydraulically powered and is controllable to raise and lower press die 34 for selectively applying pressure to circular blank 30 along a pressure axis 40. Automatic dishing press system 32 also includes an automatic manipulator 42 for moving circular blank 30 relative to pressure axis 40. The first stage of cold-forming the circular blank 30 includes repeatedly positioning the circular blank relative to the pressure axis and applying pressure to different localized regions of the circular blank. The operator of automatic dishing press system 32 may manually input control commands to control the pressure strokes of press die 34 and the positioning movements of circular blank 30 to gradually cold-form the circular blank into an intermediate ellipsoidal dish 50, depicted in FIG. 5. Intermediate ellipsoidal dish 50 may be cold-formed by forming circular blank 30 to provide a primary dish radius DR that is 90% in length relative to the intended outer diameter OD of the completed tank head. Automatic dishing press system 32 is preferably a CNC machine tool capable of recording the commands inputted by the operator, whereby an automatic program may be created and stored to eliminate the need for manual input of commands when running subsequent tank car heads of the same size and material. By way of non-limiting example, automatic dishing press system may include a Series PPM-600/5 Hydraulic Dishing Press and a Model MA-80 Automatic Manipulator for Dishing Press available from Faccin USA, Inc. of South Tampa, Fla. and Italy.

Applicant has experimented with stacking two circular blanks 30 on an automatic dishing press and cold-forming two intermediate ellipsoidal dishes simultaneously. This procedure was successful in producing two intermediate ellipsoidal dishes 50 in approximately half the time it takes to produce a single intermediate ellipsoidal dish 50 when only one circular blank 30 is loaded in the automatic dishing press.

Figure 6:
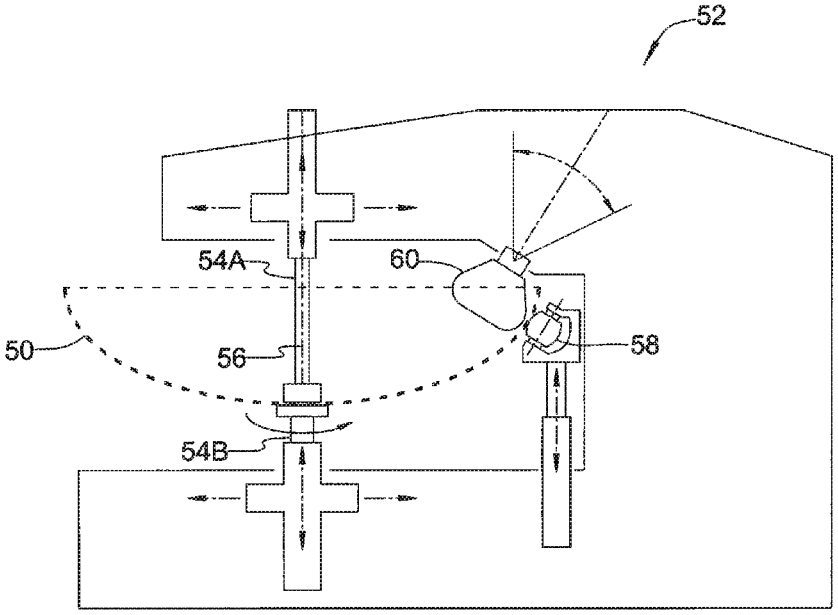
FIG. 6 is a schematic side view of a flanging machine used in a second cold-forming stage of the process.
Figure 7:
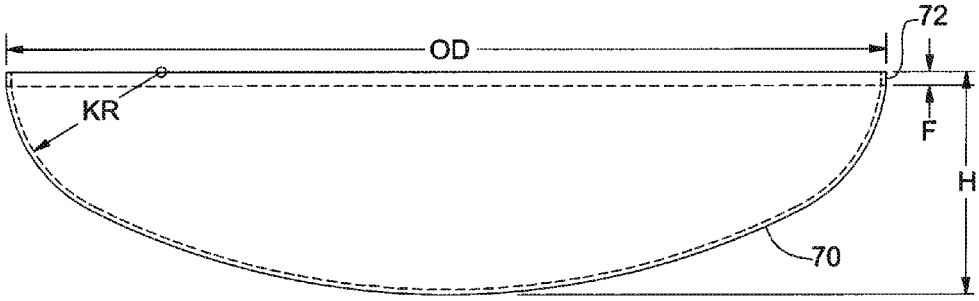
FIG. 7 is a side view of a flanged ellipsoidal dish formed from the intermediate ellipsoidal dish in accordance with the second cold-forming stage.
Figure 8:
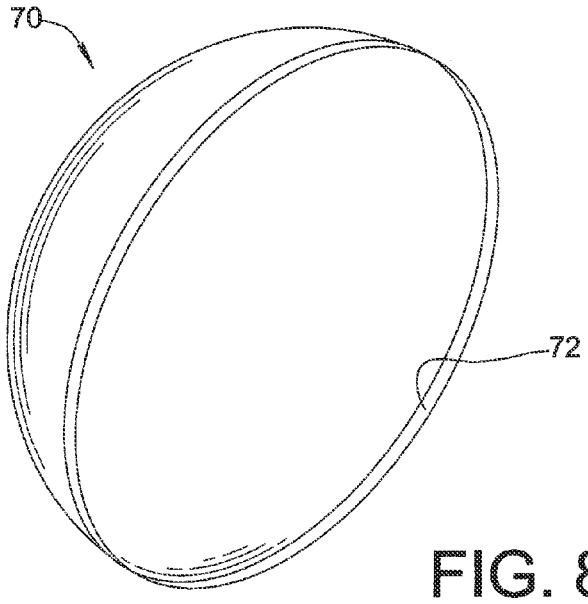
FIG. 8 is an orthogonal view of the flanged ellipsoidal dish shown in FIG. 7.

The second cold-forming stage, represented by block 16, is cold-forming a peripheral flange region of the intermediate ellipsoidal dish 50 to form a flanged ellipsoidal dish 70. The second stage of cold-forming may be performed by an automatic flanging machine, illustrated schematically in FIG. 6 and identified generally by reference numeral 52. Automatic flanging machine 52 includes a clamping axle 54A, 54B operable to clamp intermediate ellipsoidal dish 50 at its center and define an axis of rotation 56 about which intermediate ellipsoidal dish 50 is rotated in spinning fashion. Flanging machine 52 further includes a flanging roll 58 operable to engage an outer surface of intermediate ellipsoidal dish 50 near its rim, and a shaping roll 60 operable to engage an inner surface of intermediate ellipsoidal dish 50. Flanging roll 58 is horizontally and vertically positionable relative to dish 50, and has an axis of rotation that is tiltable in a vertical plane. Likewise, shaping roll 60 is horizontally and vertically positionable relative to dish 50, and has an axis of rotation that is tiltable in a vertical plane. Flanging machine 52 may also include guide rolls (not shown) operable to engage the underside of intermediate ellipsoidal dish 50 as it rotates about axis 56. As will be understood, as intermediate ellipsoidal dish 50 is rotated, flanging roll 58 may be positioned and its tilt angle may be adjusted as it engages the dish to alter the profile of the dish. The position and tilt angle of shaping roll 60 may also be adjusted as shaping roll engages dish 50 to assist in gradually altering the profile of dish 50 in a controlled manner. In this way, intermediate ellipsoidal dish 50 is cold-formed into a flanged ellipsoidal dish 70 as illustrated in FIG. 7. Flanged ellipsoidal dish 70 a secondary knuckle radius KR that is 17.3% in length relative to the tank head OD, wherein the knuckle radius KR is blended with the primary dish radius DR. Flanged ellipsoidal dish 70 further includes a straight flange region 72 at the periphery of the dish. An example of an automatic flanging machine suitable for use in practicing the present invention is a Type BF 25/6 Automatic Flanging Machine available from Faccin USA, Inc. of South Tampa, Fla. This is but one example, and other flanging machines may be used without straying from the invention. Similar to the first stage of cold-forming, the second stage of cold forming may be controlled by programming automatic flanging machine 52.

During the second stage of cold-forming, frictional contact between rollers 58 and 60 and the spinning dish 50 is converted to heat that raises the temperature of the steel. If the steel is heated above 200° F., unexpected material deformation may occur. Therefore, the temperature of the steel is monitored in conjunction with rotating dish 50. In FIG. 1, this is represented by blocks 18 and 20 executed simultaneously with the flanging operation. The temperature may be monitored while the dish is spinning by an infra-red thermal meter (i.e. a "heat gun") or by thermo-melt heat sticks. Decision block 20 determines if the measured temperature is approaching the 200° F. limit. If so, a temporary pause 22 is provided in the cold-forming operation to allow heat to dissipate.

The dimensions of flanged ellipsoidal dish 70 will depend on the diameter of the railroad car tank for which the tank car head is intended. Purely by way of example, applicant has successfully tested its method in meeting a railroad tank head specification calling for an outer diameter (OD) of 123.5 inches, an overall height H of 34.251 inches, and a flange height F of 2.625 inches. While the flanged ellipsoidal dish 70 is loaded in flanging machine 52, an edge conditioning operation may be run using a shaving tool positioned to shave the top edge of flange region 72 to achieve a desired flatness tolerance of flange region. The edge conditioning operation prepares flanged ellipsoidal dish 70 for welding to an end of a cylindrical tank by a circumferential weld.

Once the flanging stage is complete, the flanged ellipsoidal dish 70 is heat treated as represented by block 24 in FIG. 1. In one embodiment, heat treatment may include thermally stress relieving the flanged ellipsoidal dish 70. In another embodiment, heat treatment may include normalizing the flanged ellipsoidal dish 70.

The thermal stress relieve procedure involves heat treating the flanged ellipsoidal dish at a temperature below the normalization temperature of the steel plate material. In an embodiment of the invention, thermal stress relieving is conducted by placing the flanged ellipsoidal dish 70 into a furnace set at not more than 800° F., ramping the furnace temperature up to 1150° F. at a rate not exceeding 400° F./hr, holding the furnace temperature at 1150° F.±50° F. for a minimum of one hour up to four hours, gradually cooling the furnace back down to 400° F. at a cooling rate not exceeding 500° F./hr, then cooling the flanged ellipsoidal dish 70 in still air. For dtress relieving, the flanged dish 70 may be supported on a fixture with the concave portion of the dish facing downward. The fixture may include internal piers and circumferential shims configured to maintain dimensional stability of the flanged dish 70, and to allow uniform heat flow to all portions of the flanged dish for uniform heating of the steel.

Figure 9:
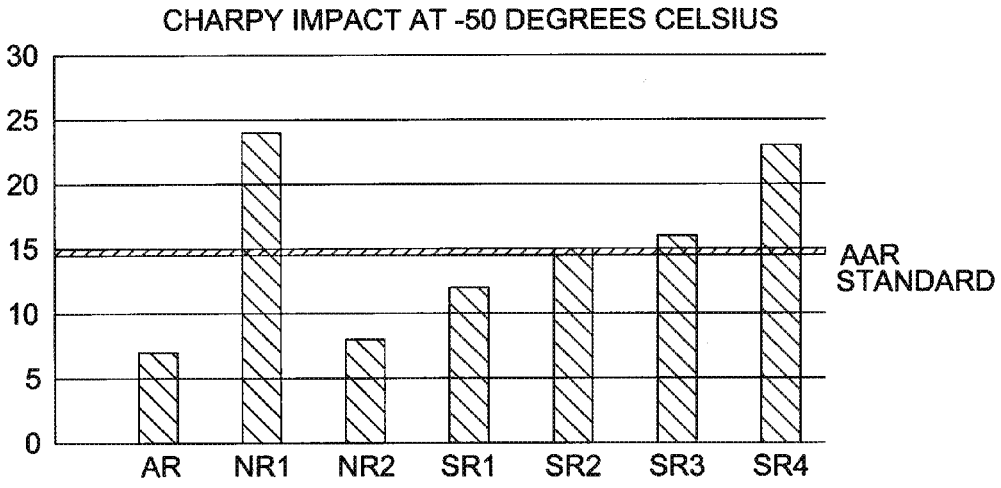
FIG. 9 is a graph illustrating Charpy impact test results for seven specimens heat treated according to various protocols.

In the thermal stress relieve procedure described above, the holding time is increased relative to conventional stress relieve procedures, which typically call for a holding time of one hour per inch of thickness (i.e. about half an hour for a 9/16 inch thick dish). The thermal stress relieve re-establishes good ductile to brittle impact characteristics of the cold-formed material at an equivalent level to that derived from normalizing heat treatment. In order to achieve this conclusion, the applicant conducted tests varying the holding time at one-hour increments (one, two, three and four hours). Applicant has found that the holding time greatly affects the material's ability to absorb impact energy, as measured by the Charpy impact test. This aspect is critical in tank car heads, as discussed above in relation to the specifications in AAR M-1002. FIG. 9 illustrates the effect of holding time and provides a comparison of lower temperature stress relieving heat treatments relative to higher temperature normalizing heat treatments. FIG. 9 shows the results of Charpy impact tests conducted at −50° C. on seven different specimens. Specimen AR ("as received") is a specimen cold-formed from ASTM TC128, Grade B, normalized steel plate that was not heat treated in any way. Specimen NR1 was normalized at 1700° F. after cold-forming and gradually cooled at a controlled rate, and specimen NR2 was also normalized at 1700° F. after cold-forming but was rapidly cooled at an uncontrolled rate. Specimens SR1, SR2, SR3, and SR4 were stress relieved at 1100° F. for one hour, two hours, three hours, and four hours, respectively, and then subjected to gradual controlled cooling. As expected, NR1 easily meets the standards in AAR M-1002. Specimens SR2, SR3 and SR4 demonstrate that stress relieving the flanged ellipsoidal dish 70 at a temperature below the normalization temperature can produce a tank car head that meets the impact toughness standards of AAR M-1002, provided that the holding time is sufficiently long and controlled cooling is used. While stress relieving for a period on a range of two hours up to four hours appears to be optimal, it is possible that a shorter time of one hour will provide sufficient toughness for certain applications.

The stress relieving step may be performed before the flanged ellipsoidal dish 70 is welded onto an end of a cylindrical tank, or it may be performed after such welding. For example, an entire welded tank of the railroad tank, including a pair of flanged ellipsoidal dishes 70 at opposite ends, may be stress relieved after fabrication and welding. In this case, thermally stress relieving the tank head before welding it to the tank body may not be required.

As mentioned, heat treatment step 24 in FIG. 1 may be a normalizing heat treatment rather than a thermal stress relieving heat treatment. The normalizing process may be carried out by heating the flanged dish 70 to a temperature just into the fully austenite region of the steel. For example, in the case where material thickness is 9/16 inches, the flanged dish 70 may be normalized at 1700° F.±50° F. for more than one-half hour but less than one hour to allow recrystallization. This is followed by cooling flanged dish 70 in air at room temperature. Normalizing refines the grain size of the steel to improve its toughness.

While the invention has been described in connection with exemplary embodiments, the detailed description is not intended to limit the scope of the invention to the particular forms set forth. The invention is intended to cover such alternatives, modifications and equivalents of the described embodiment as may be included within the spirit and scope of the invention.

What is claimed is:

1. A method of manufacturing a plurality of railroad car tank heads comprising the steps of:

providing a plurality of circular blanks of steel plate material, wherein the steel plate material is at least ½ inches thick;

simultaneously cold forming the plurality of circular blanks to form a plurality of intermediate ellipsoidal dishes, wherein a temperature of each blank is not greater than 200° F. during the cold-forming;

cold-forming a peripheral flange region of each intermediate ellipsoidal dish to form a flanged ellipsoidal dish, wherein a temperature of each intermediate ellipsoidal dish is not greater than 200° F. during the cold-forming of the flange region; and heat treating each flanged ellipsoidal dish, wherein the step of heat treating includes thermally stress relieving each flanged ellipsoidal dish at a temperature below the normalization temperature of the steel plate material by heating each flanged ellipsoidal dish to 1150° F.±50° F. and holding each flanged ellipsoidal dish at 1150° F.±50° F. for at least one hour.

2. The method according to claim 1, wherein the steel plate material is AAR TC128, Grade B, normalized steel.

3. The method of claim 1, wherein the step of cold-forming the plurality of circular blanks is performed by an automatic dishing press system.

4. The method of claim 1, further comprising the step of monitoring the temperature of the steel in conjunction with the step of cold-forming the peripheral flange region of each intermediate ellipsoidal dish.

5. The method of claim 4, wherein the step of cold-forming the peripheral flange region of each intermediate ellipsoidal dish is temporarily paused to allow cooling of the steel, whereby the temperature of the steel is maintained at or below a predetermined limit.

6. The method of claim 1, wherein the step of heat treating each flanged ellipsoidal dish includes normalizing each flanged ellipsoidal dish.

7. A method of manufacturing a railroad car tank head comprising the steps of:

providing a circular blank of steel plate material, wherein the steel plate material is at least ½ inches thick;

cold-forming the circular blank to form an intermediate ellipsoidal dish, wherein a temperature of the blank is not greater than 200° F. during the cold-forming;

cold-forming a peripheral flange region of the intermediate ellipsoidal dish to form a flanged ellipsoidal dish, wherein a temperature of the intermediate ellipsoidal dish is not greater than 200° F. during the cold-forming of the flange region; and heat treating the flanged ellipsoidal dish, wherein the step of heat treating includes thermally stress relieving the flanged ellipsoidal dish at a temperature below the normalization temperature of the steel plate material by heating the flanged ellipsoidal dish to 1150° F.±50° F. and holding the flanged ellipsoidal dish at 1150° F.±50° F. for at least one hour.

8. The method of claim 7, wherein the flanged ellipsoidal dish is held at 1150° F.±50° F. for up to four hours.

9. The method of claim 7, wherein the step of thermally stress relieving the flanged ellipsoidal dish further includes cooling the heated flanged ellipsoidal dish at a controlled rate of cooling not exceeding 500° F./hr.

10. The method of claim 9, wherein the step of thermally stress relieving the flanged ellipsoidal dish further includes cooling the heated flanged ellipsoidal dish in still air.

11. The method of claim 7, wherein the step of thermally stress relieving the flanged ellipsoidal dish is performed before the flanged ellipsoidal dish is welded onto a cylindrical tank.

12. The method of claim 7, wherein the step of thermally stress relieving the flanged ellipsoidal dish is performed after the flanged ellipsoidal dish is welded onto a cylindrical tank.

13. The method of claim 7, wherein the step of heat treating the flanged ellipsoidal dish includes normalizing the flanged ellipsoidal dish.

* * * * *